US005575412A

United States Patent [19]

Arias

[11] Patent Number: 5,575,412

[45] Date of Patent: Nov. 19, 1996

[54] SKI CARRIER

[76] Inventor: Fred Arias, 302 Third St., Huntington Beach, Calif. 92648

[21] Appl. No.: 897,907

[22] Filed: Jun. 12, 1992

[51] Int. Cl.[6] ..... A45F 3/14

[52] U.S. Cl. ..... 224/257; 224/917; 224/901

[58] Field of Search ..... 224/257, 258, 224/917, 264, 913, 901

[56] References Cited

U.S. PATENT DOCUMENTS

| | | | |
|---|---|---|---|
| 794,948 | 7/1905 | Rischard | 224/257 |
| 2,530,695 | 11/1950 | Helmert | 224/917 |
| 3,960,302 | 6/1976 | Mazzoni, Jr. | 224/257 |
| 4,456,284 | 6/1984 | Saka | 224/917 |
| 4,470,528 | 9/1984 | Dyess | 224/257 |
| 4,518,107 | 5/1985 | Ames | 224/215 |
| 4,658,999 | 4/1987 | Hilty | 224/202 |
| 5,160,074 | 11/1992 | Coates | 224/257 |

*Primary Examiner*—David J. Walczak
*Attorney, Agent, or Firm*—Hawes, Fischer & Dickinson

[57] ABSTRACT

A carrier to be worn to easily transport elongated articles such as, for example, pairs of skis and poles. In the preferred embodiment, the carrier comprises a shoulder strap, a first end strap at one end of the shoulder strap adapted to be releasably attached to first ends of the pair of skis, a first auxiliary strap at the first end strap adapted to be releasably attached to first ends of the pair of poles, a second end strap at the opposite end of the shoulder strap adapted to be releasably attached to second ends of the pair of skis, and a second auxiliary strap at the second end strap adapted to be releasably attached to second ends of the pair of poles. A cross strap extends from one of the end straps around the back, under the shoulder, and across the chest of the wearer to be releasably attached to the shoulder strap to exert a pulling force thereon and thereby prevent the shoulder strap from sliding off the shoulder of the user. By virtue of the foregoing, the user need not hold onto the shoulder strap but has use of both his hands to perform other tasks.

14 Claims, 4 Drawing Sheets

SKI CARRIER

BACKGROUND OF THE INVENTION

1. Field of the Invention

This invention relates to a carrier to be worn by a skier for enabling the skier to easily carry pairs of skis and poles, or the like, alongside his body without the carrier sliding off and the skis and poles falling to the ground. Moreover, the skier need not hold the carrier, thereby freeing his hands to perform other tasks.

2. Background Art

As will be known to those skilled in the art, it is a cumbersome and sometimes difficult task for a skier to carry pairs of skis and poles over a long distance, particularly when there is heavy snow on the ground. The skis and poles are usually bulky and heavy and, consequently, may be dropped or cause the skier to loose his balance during transport.

Accordingly, carriers have been proposed which are to be worn by the skier and coupled to his skis and poles to enable the skier to more easily carry said skis and poles over long distances. Generally, such carriers include a strap that is worn over the skier's shoulder to support the weight of the skis and poles. However, this support strap is known to frequently slide off the shoulder of the skier, particularly when the skier walks, bends over or turns his body. To overcome the tendency of the support strap to slide off his shoulder, the skier typically uses one of his hands to grasp and hold onto such strap. This action requires the constant attention of the skier and leaves only one hand free to perform other tasks.

Examples of carriers which can be worn by a skier to facilitate transport of his skis and poles but which are characterized by the shortcomings described above are available by referring to the following U.S. patents:

| | |
|---|---|
| 4,456,284 | June 26, 1984 |
| 4,470,528 | September 11, 1984 |
| 4,518,107 | May 21, 1985 |
| 4,658,999 | April 21, 1987 |

SUMMARY OF THE INVENTION

In general terms, a carrier is disclosed which, in a preferred embodiment, is to be worn by a skier to facilitate the transport of pairs of skis and poles without the carrier sliding off the skier. The carrier includes an elongated shoulder strap having first and second ski supporting straps secured to respective opposite ends of the shoulder strap so as to form an I-shaped configuration. One end of a first pole supporting strap is affixed to a first ski supporting strap and the opposite end of the first pole supporting strap is free. One end of a second pole supporting strap is affixed to the second ski supporting strap and the opposite end of the second pole supporting strap is free. One end of a cross strap is affixed to one of the ski supporting straps and the opposite end of the cross strap is free. Each of the shoulder strap, ski supporting straps, pole supporting straps and cross strap has one or more strips of self-locking (e.g. Knit and Loop) fastening material attached thereto.

In operation, a first ski supporting strap at one end of the shoulder strap is wrapped around first ends of the pair of skis. Opposing sides of the first ski supporting strap are releasably secured together by means of opposing strips of self-locking material. The second ski supporting strap at the opposite end of the shoulder strap is wrapped around second ends of the skis. Opposing ends of the second ski supporting strap are releasably secured together by means of opposing strips of self-locking material. Next, the free end of a first pole supporting strap is wrapped around first ends of the pair of poles and releasably secured to the first ski supporting strap from which said pole supporting strap depends by means of opposing strips of self-locking material, whereby to hold the first ends of said skis and poles together. The free end of the second pole supporting strap is wrapped around second ends of the poles and releasably secured to the second ski supporting strap from which said second pole supporting strap depends by means of opposing strips of self-locking material, whereby to hold the second ends of said skis and poles together. The skier then places the shoulder strap extending between the first and second ski supporting straps over one shoulder to support the weight of the skis and poles alongside the skier's body. Lastly, the skier pulls the free end of the cross strap across his back, under his arm and then across his chest in order to releasably secure the cross strap to the shoulder strap in front of the skier's chest by means of opposing strips of self-locking material.

By virtue of the cross strap being secured to and pulling upon the shoulder strap, the shoulder strap will not inadvertently slide off the skier's shoulder with the skis and poles falling on the ground. Moreover, the skier is not required to hold onto the carrier, thereby leaving both his hands free to perform other tasks.

DETAILED DESCRIPTION

Figure 1:
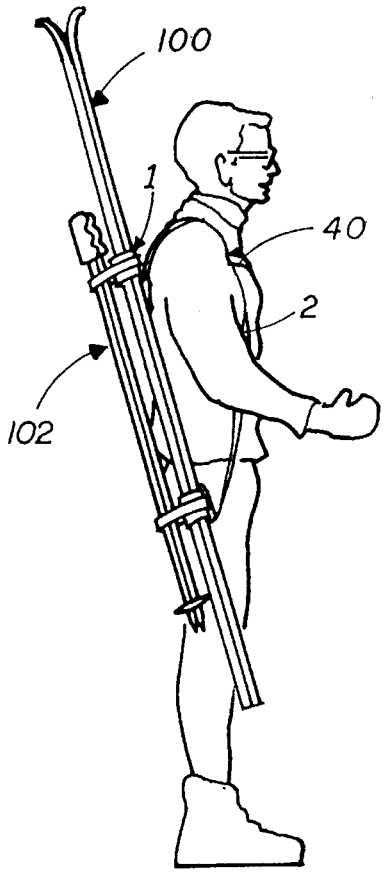
FIGS. 1–3 illustrates the carrier which forms the present invention coupled to pairs of skis and poles and worn by a skier to facilitate the transport of said skis and poles from one place to another.
Figure 3:
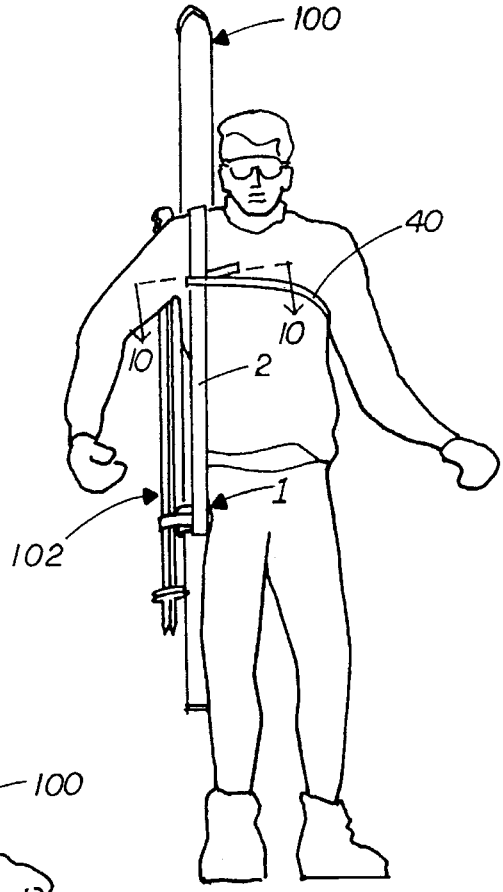
Figure 2:
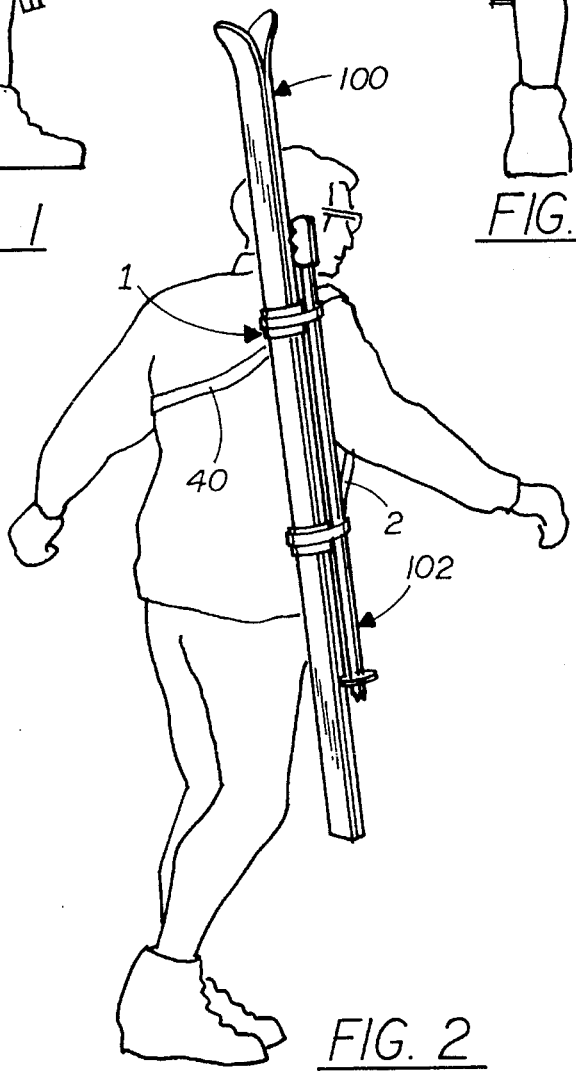

Referring to the drawings, FIGS. 1, 2 and 3 show the ski carrier 1 which forms the present invention for enabling a skier to easily transport pairs of skis 100 and poles 102. More particularly, by virtue of a soon to be described shoulder support strap 2 and cross strap 40 cooperating with one another, the skis and poles 100 and 102 may be carried along side the body of the skier while leaving both hands of the skier free to perform other tasks. In addition, the ski carrier 1 may be quickly and easily worn and removed from the body of the skier to facilitate use.

Figure 4:
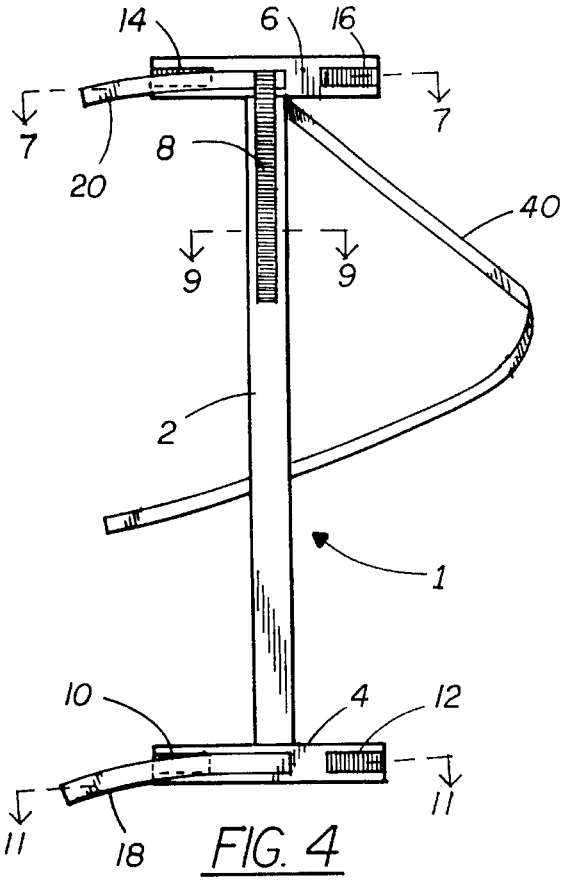
FIG. 4 shows the front of the ski carrier laid flat.
Figure 5:
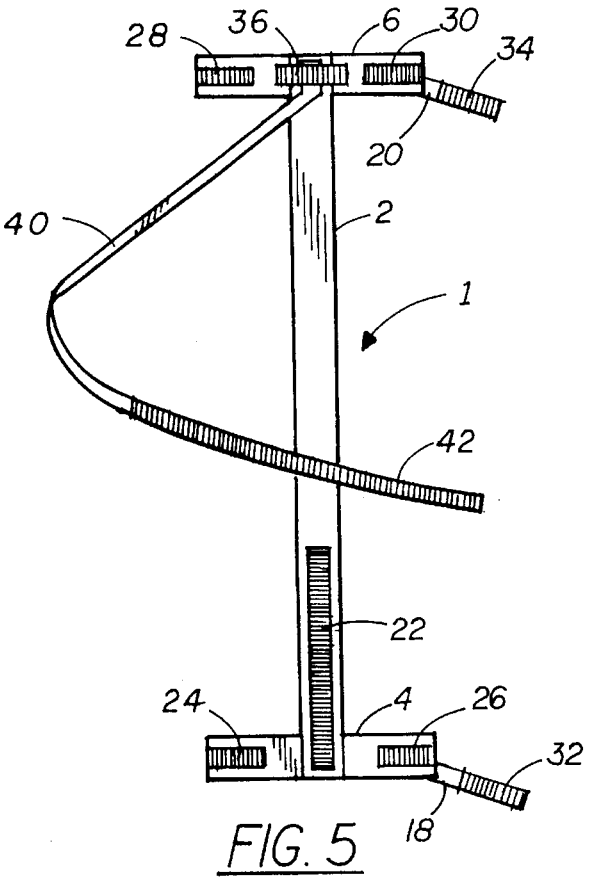
FIG. 5 shows the rear of the ski carrier laid flat.

FIGS. 4 and 5 of the drawings show the front and rear of the ski carrier 1 laid flat and detached from the skis and poles (of FIGS. 1–3) to which said carrier will otherwise be attached during use. The carrier 1 is preferably manufactured from a plurality of strips of flexible fabric that are connected (e.g. sewn) together. More particularly, the carrier 1 includes a relatively long shoulder strap 2 having respective ski supporting straps 4 and 6 fixedly attached to opposite ends of strap 2. The ski supporting end straps 4 and 6 are aligned parallel to each other and perpendicular to the support strap 2 to which they are affixed so as to form a symmetrical I-shaped configuration.

Figure 9:
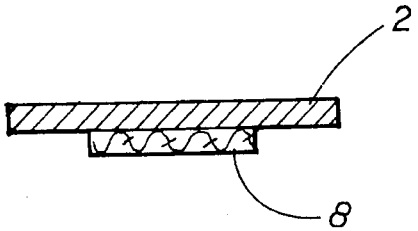
FIG. 9 is a cross section taken along lines 9—9 of FIG. 4.

Referring specifically to FIG. 4, a strip of self-locking fastening material 8 extends from ski supporting end strap 6 and runs longitudinally along a portion of the shoulder strap 2 at the front of carrier 1 (also shown at FIG. 9). According to a preferred embodiment, the self-locking fastening material used throughout this description is known commercially as Knit and Loop material manufactured by the 3M Company. Front facing strips of self-locking fastening material 10 and 12 are located at each side of ski supporting end strap 4. Likewise, front facing strips of self-locking fastening material 14 and 16 are located at each side of ski supporting end strap 6. One end of a first auxiliary pole supporting strap 18 is fixedly attached to the ski supporting strap 4 at the intersection of shoulder strap 2 and end strap 4 at the front of carrier 1. One end of a second auxiliary pole supporting strap 20 is fixedly attached to the ski supporting strap 6 at the intersection of shoulder strap 2 and end strap 6 also at the front of carrier 2. In the configuration illustrated in FIGS. 4 and 5, the opposite ends of pole supporting straps 18 and 20 are initially free from attachment to carrier 1. The function and operation of ski supporting end straps 4 and 6 and auxiliary pole supporting straps 18 and 20 will be described in greater detail hereinafter.

As is best shown in FIG. 5, a rear facing strip of self-locking fastening material 22 extends from ski supporting strap 4 and runs longitudinally along a portion of shoulder strap 2. Rear facing strips of self-locking fastening material 24 and 26 are located at each side of the ski supporting strap 4. Likewise, rear facing strips of self-locking fastening material 28 and 30 are located at each side of ski supporting strap 6. A strip of self-locking fastening material 32 is located at the fixed end of pole supporting strap 18, and a strip of self-locking fastening material 34 is located at the fixed end of pole supporting strap 20 at the rear of carrier 1. The cross strap 40, mentioned briefly when referring to FIGS. 1–3, has a first end which is fixedly attached to the rear of carrier 1 (at the intersection of shoulder strap 2 and ski supporting strap 6) and an opposite end which is initially free from attachment. A strip of self-locking fastening material 42 is located at the free end of cross strap 40 at the rear of carrier 1.

Figure 7:
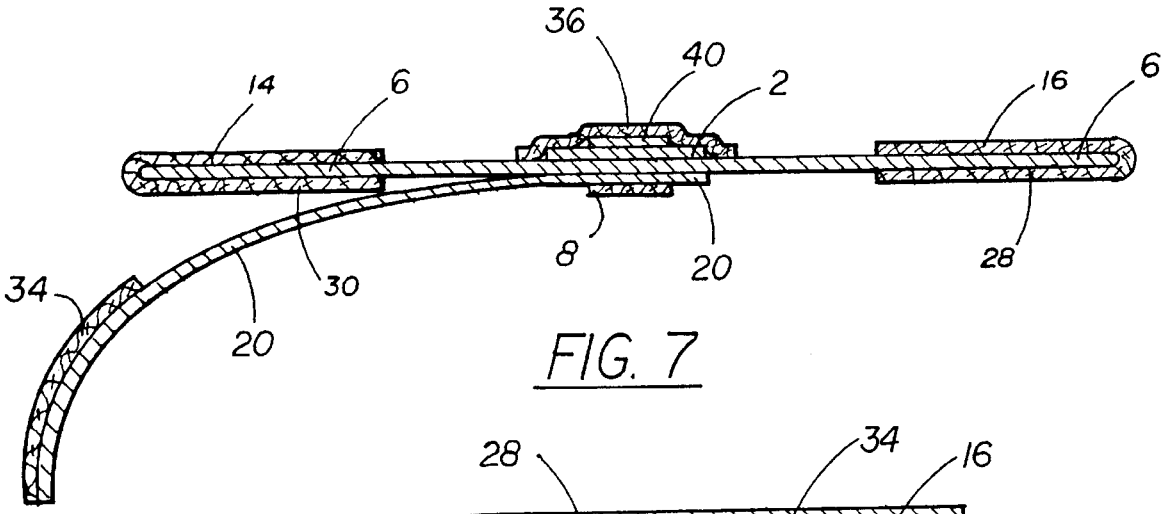
FIG. 7 is a cross section taken along lines 7—7 of FIG. 4.
Figure 11:
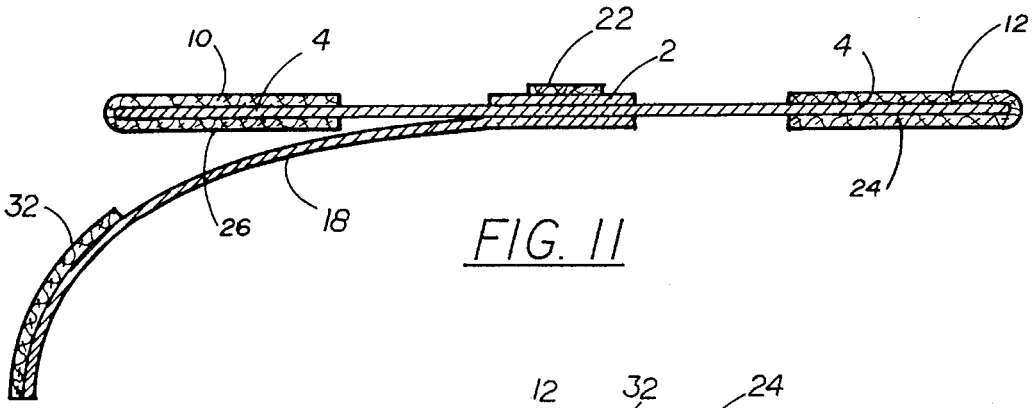
FIG. 11 is a cross section taken along lines 11—11 of FIG. 4.

The strips of fastening material 14, 30 and 16, 28 that are located at the front and rear of ski supporting strap 6 may be either discrete strips of Knit and Loop material or, as shown in FIG. 7, strip 14 may be continuous with strip 30 and strip 16 may be continuous with strip 28. Likewise, the strips of fastening material 10, 26 and 12, 24 that are located at the front and rear of ski supporting strap 4 may be either discrete strips or, as shown in FIG. 11, strip 4 may be continuous with strip 12 and strip 10 may be continuous with strip 26.

As shown in FIG. 5, a strip of self-locking fastening material 36 is located at the rear of ski supporting strap 6 between strips of fastening material 28 and 30. This enables shoulder strap 2 to be worn as a belt when carrier 1 is not being used with skis and poles. More particularly, strip 36 enables the ski supporting strap 6 to be folded up and held in a relatively tight roll at one end of shoulder strap 2, while fastening material 22 enables ski supporting strap 4 to be folded up and held in a relatively tight roll at the opposite end of shoulder strap 2. The strap 2 is then wrapped around the skiers waist, and the strip of fastening material 22 is mated to the strip of fastening material 8 to hold the belt in place. The cross strap 40 may be tucked inside the belt loop formed by shoulder strap 2.

Figure 6:
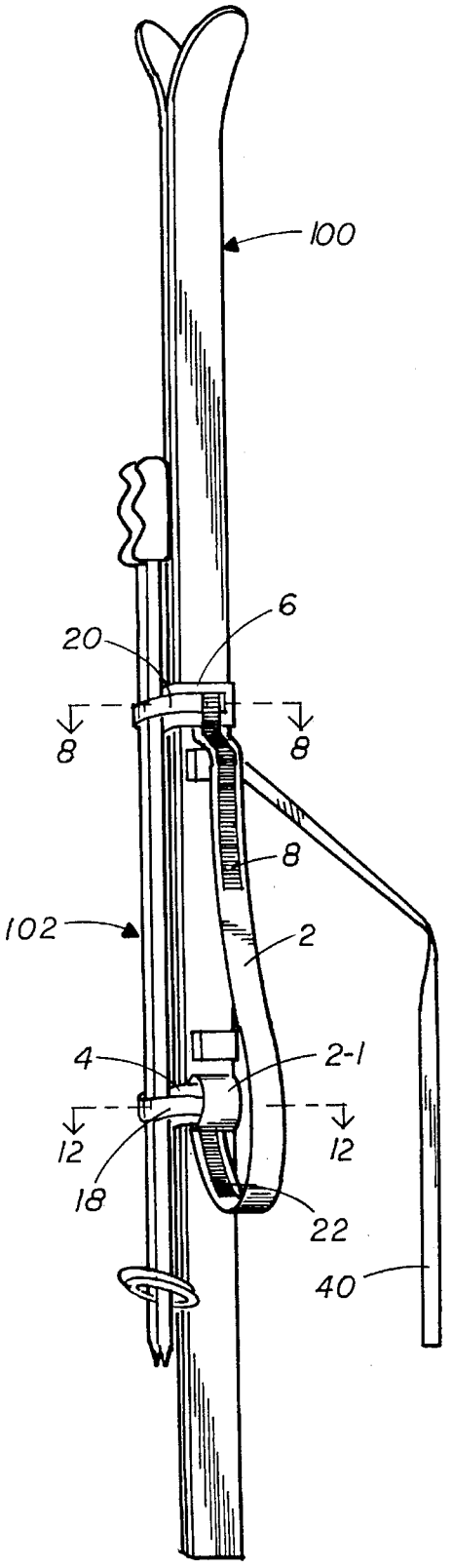
FIG. 6 shows the ski carrier of FIGS. 4 and 5 coupled to pairs of skis and poles and ready to be worn by the skier.

FIG. 6 shows the ski carrier 1 of FIGS. 4 and 5 attached to the pairs of skis and poles 100 and 102 of FIGS. 1–3 to permit the easy transport thereof. In operation, the front of the ski carrier 1 (as shown in FIG. 4) is positioned adjacent (e.g. underneath) the skis and poles to be carried, and the ski supporting strap 6 is wrapped around one end of the skis 100. After the ski supporting strap 6 is secured to skis 100, the pole supporting strap 20, one end of which is affixed to strap 6, is wrapped around one end of the poles 102. Thus, the ski supporting strap 6 and pole supporting strap 20 cooperate with one another to detachably connect the first ends of the skis and poles 100 and 102 together.

Figure 8:
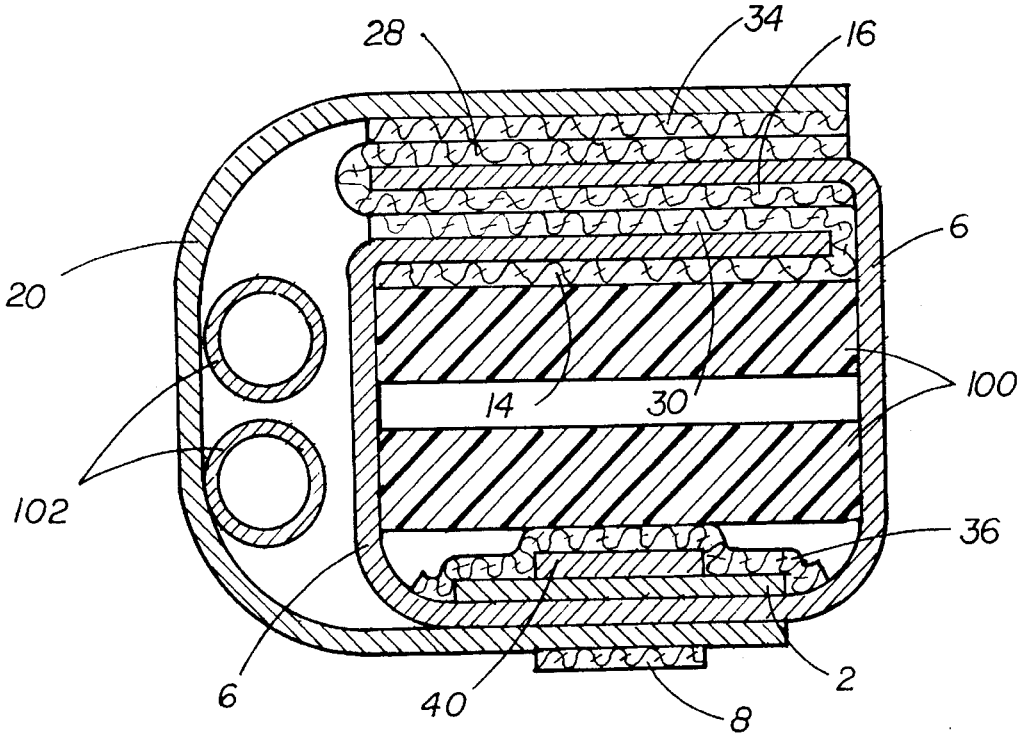
FIG. 8 is a cross section taken along lines 8—8 of FIG. 6.

That is, and referring to FIG. 8, the ski supporting strap 6 is wrapped around the skis 100, such that opposite sides of said strap 6 are aligned face to face and releasably attached to one another by means of opposing strips of fastening material 16 and 30. The strip of fastening material 14 at the front of strap 6 abuts one of the skis, while the strip of fastening material 28 at the rear of strap 6 is positioned so as to be mated to the free end of pole supporting strap 20. Thus, pole supporting strap 20 is wrapped around the poles 102 and moved into contact with the rear of ski supporting strap 6 such that the strip of fastening material 34 of strap 20 is releasably attached to the strip of fastening material 28 of strap 6.

Next, and referring once again to FIG. 6, the ski supporting strap 4 is wrapped around the second end of the skis 100, and the pole supporting strap 18, one end of which is affixed to strap 4, is wrapped around the second end of the poles 102. Thus, the ski supporting strap 4 and pole supporting strap 18 cooperate with one another to detachably connect the second ends of the skis and poles 100 and 102 together.

As was earlier disclosed, the shoulder strap 2 extends between the ski supporting end straps 4 and 6. With the ski carrier 1 laid flat, as shown in FIGS. 4 and 5, the length of shoulder strap 2 along the longitudinal axis thereof is about four feet. However, for certain applications, such as for carrying the skis and poles 100 and 102 shown in FIG. 6, it may be desirable to shorten the length of shoulder strap 2 without having to rely upon complicated or potentially dangerous clips and buckles. To accomplish the foregoing, one end of shoulder strap 2 (e.g. the end at which ski supporting strap 4 is located) is rolled up into a relatively tight ball 2-1. This ball 2-1 at the end of shoulder strap 2 may contain any number of turns as needed to adjust the length of strap 2 to correspond with the length of the article being carried (best illustrated in FIG. 12).

Figure 12:
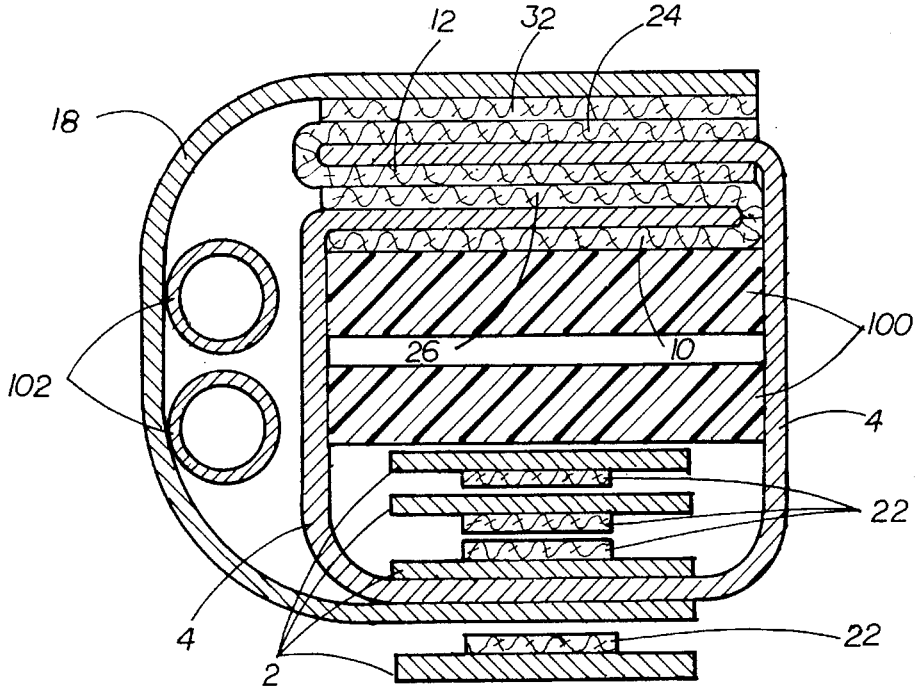
FIG. 12 is a cross section taken along lines 12—12 of FIG. 6.

Once the length of shoulder strap 2 is established in the manner just described, and referring specifically to FIG. 12, the ski supporting strap 4 is wrapped around the skis 100, such that opposite sides of the strap 4 are aligned face-to-face and releasably attached to one another by means of opposing strips of fastening material 12 and 26. The strip of fastening material 10 at the front of strap 4 abuts one of the skis, while the strip of fastening material 24 at the rear of strap 4 is positioned so as to be mated to the free end of pole supporting strap 18. That is, pole supporting strap 18 is wrapped around the poles 102 and moved into contact with the rear of ski supporting strap 4, such that the strip of fastening material 32 of strap 18 is releasably attached to the strip of fastening material 12 of strap 4.

The use of the cross strap 40 of ski carrier 1 to permit the skis and poles 100 and 102 to be carried alongside the skier without sliding off is now disclosed. After the ski supporting straps 4 and 6 and pole supporting straps 18 and 20 have been secured to the skis and poles 100 and 102, as disclosed when referring to FIG. 6, the shoulder strap 2 which extends between end straps 4 and 6 is positioned over either one of the skier's shoulders so that the skis are carried at the rear and to one side of the skier's body. In the past, similar shoulder straps have been known to slide off the skier's shoulder thereby requiring that the skier hold onto the shoulder strap to avoid having his skis and poles undesirably fall to the ground. However, the cross strap 40 when used in combination with shoulder strap 2 avoids the foregoing problem while leaving the skier's hands free to perform other tasks.

As was previously disclosed when referring to FIG. 5, one end of cross strap 40 is fixedly attached to the ski supporting end strap 6 of shoulder strap 2, and the opposite free end of strap 40 is provided with a strip of fastening material 42. As is best shown in FIGS. 1–3, the free end of cross strap 40 is pulled first across the back, then under the arm and finally across the chest of the skier to be releasably secured to the shoulder strap 2 at the highest accessible point therealong.

Figure 10:
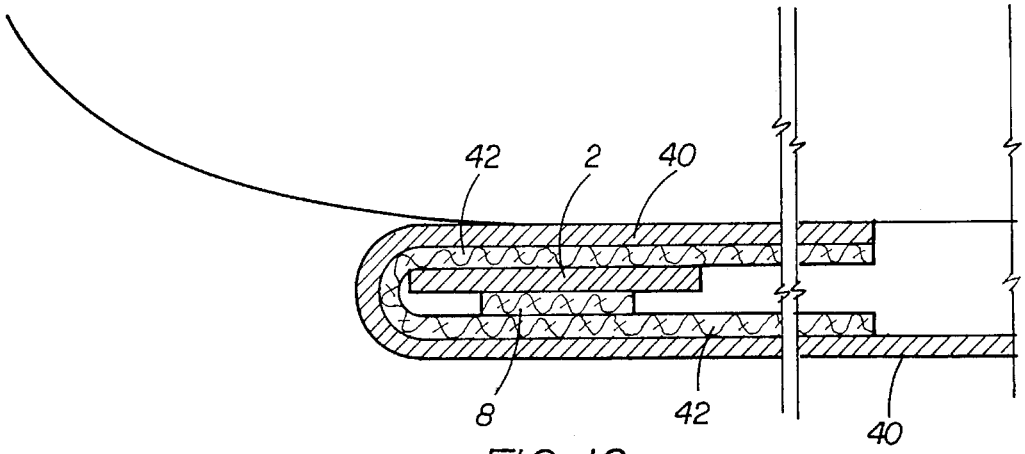
FIG. 10 is a cross section taken along lines 10—10 of FIG. 3.

More particularly, and referring now to FIG. 10 of the drawings, the free end of cross strap 40 is wrapped around the shoulder in front of the skier's chest, such that the strip of fastening material 42 from cross strap 40 is mated to the opposing strip of fastening material 8 from shoulder strap 2. Accordingly, the shoulder strap 2 provides an axially directed force to support the weight of the skis and poles, while the cross strap 40 provides a laterally directed pulling force to the shoulder strap 2 to prevent said strap 2 from sliding off the skier's shoulder.

Of course, ski carrier 1 may be quickly and easily removed from the skier by simply detaching the cross strap 40 from the shoulder strap 2 by breaking the bond that was previously established between the respective strips of fastening material 8 and 42. Likewise, the ski supporting straps 4 and 6 and the pole supporting straps 18 and 20 may be opened to detach the ski carrier 1 from the skis and poles being carried thereby.

It will be apparent that while a preferred embodiment of the invention has been shown and described, various modifications and changes may be made without departing from the true spirit and scope of the invention. For example, and as is best shown in FIGS. 4 and 5, it may be noted that the ski carrier 1 is symmetrical with regard to its I-shaped configuration and location of the strips of self-locking fastening material. By virtue of the foregoing, the ski supporting strap 4 may be attached to the skis 100 before or after the ski supporting strap 6. Moreover, the ski supporting strap 4 may be attached to either end of the pair of skis 100. Thus, the specific reference in FIGS. 4 and 5 to the front and rear of ski carrier 1 is for purpose of description only and is not to be regarded as a limitation of the present invention. What is more, it is to be understood that the carrier 1 of the present invention has application for conveniently and easily transporting elongated apparatus other than the skis and poles shown and described. For example, carrier 1 may be interfaced with a rifle, tripod, bow and arrow, golf clubs, snow board, etc. Therefore, while skis and poles have been described herein as being transported by carrier 1, this is the preferred embodiment only and is not intended to be taken as a limitation of the uses to which carrier 1 may be put.

Having thus set forth the preferred embodiment, what is claimed is:

1. A carrier by which to enable a user to transport a pair of skis and a pair of poles, each of said pairs having first and second ends, said carrier comprising;

a first end strap adapted to be attached to the first end of the pair of skis to be transported;

a second end strap adapted to be attached to the second end of the pair of skis to be transported;

a shoulder strap connected between said first and second end straps and adapted to be worn over a shoulder of the user after said first and second end straps have been attached to the skis;

a first auxiliary strap having one end thereof fixedly attached to said first end strap and an opposite free end surrounding the first end of the pair of poles to be transported and attached to said first end strap so as to couple the first ends of said pairs of skis and poles together;

a second auxiliary strap having one end thereof fixedly attached to said second end strap and an opposite free end surrounding the second end of the pair of poles and attached to said second end strap so as to couple the second ends of said pairs of skis and poles together;

a cross strap attached to said carrier for exerting a pulling force on said shoulder strap to prevent said shoulder strap from sliding off the shoulder of the user, said cross strap having a first end connected to said first end strap and an opposite free end;

first attachment means located on the free end of said cross strap; and second attachment means located on said shoulder strap, said first and second attachment means being mated together to detachably connect the free end of said cross strap to said shoulder strap.

2. The carrier recited in claim 1, further comprising fastener means located on said first end strap to enable said first end strap to be releasably attached to the first end of said article to be transported.

3. The carrier recited in claim 2, wherein said fastener means on said first end strap includes first and second pieces of self-locking fastening material, said first end strap wrapped around said article to be transported such that said first and second pieces of fastening material are moved into contact with and mated to one another, whereby to attach said first end strap to said article.

4. The carrier recited in claim 1, further comprising fastener means located on said second end strap to enable said second end strap to be releasably attached to the second end of said article to be transported.

5. The carrier recited in claim 4, wherein said fastener means on said second end strap includes first and second pieces of self-locking fastening material, said second end strap wrapped around said article to be transported such that said first and second pieces of fastening material are moved into contact with and mated to one another, whereby to attach said second end strap to said article.

6. The carrier recited in claim 1, wherein said first attachment means on the free end of said cross strap includes a first piece of self-locking fastening material, and said second attachment means on said shoulder strap includes a second piece of self-locking fastening material, said free end of said cross strap moved into contact with said shoulder strap such that the first piece of fastening material on said free end is mated to the second piece of fastening material on said shoulder strap, whereby to detachably connect said cross strap to said shoulder strap.

7. The carrier recited in claim 1, further comprising a piece of self-locking fastening material located on said shoulder strap between said first and second end straps, one of said first or second end straps being rolled along said shoulder strap in a direction towards the other end strap so as to shorten the length of said shoulder strap therebetween and cause one end of said piece of fastening material to be moved into contact with and mated to the opposite end of said piece of fastening material, whereby to prevent said one end strap from being unrolled in a direction away from said other end strap.

8. A carrier by which to enable a user to transport pairs of skis and poles, each of said skis and poles having first and second ends, and said carrier comprising:

a first end strap adapted to be attached to the first ends of said pair of skis to be transported;

a second end strap adapted to be attached to the second ends of the skis to be transported;

a shoulder strap connected between said first and second end straps and adapted to be worn over a shoulder of the user after said first and second end straps have been attached to said skis;

a cross strap to be attached to said shoulder strap to exert a pulling force thereon so as to prevent said shoulder strap from sliding off the shoulder of the user, said cross strap having a first end thereof attached to one of said first or second end straps and an opposite end releasably attached to said shoulder strap such that said cross strap extends from the one of said first or second end straps, across the back and under the shoulder of the user, to said shoulder strap to be releasably attached thereto adjacent the user's chest so that said cross strap exerts the pulling force on said shoulder strap in a direction across the chest of the wearer;

a first auxiliary strap having one end thereof fixedly attached to said first end strap and an opposite end adapted to be attached to the first ends of said pair of poles to be transported so as to couple the first ends of said skis and the first ends of the poles together;

a second auxiliary strap having one end thereof fixedly attached to said second end strap and an opposite end adapted to be attached to the second ends of said pair of poles so as to couple the second ends of said skis and the second ends of the poles together; and a first piece of self-locking fastening material located on the opposite end of said first auxiliary strap and a second piece of self-locking fastening material located on said first end strap, said opposite end of said first auxiliary strap surrounding the first ends of said pair of poles and moved into contact with said first end strap such taht said first and second pieces of self-locking fastening material are mated together, whereby to couple the first ends of said pair of skis and the first ends of said pairs of poles together.

9. The carrier recited in claim 8, further comprising a third piece of self-locking fastening material located on the opposite end of said second auxiliary strap and a fourth piece of self-locking fastening material located on said second end strap, said opposite end of said second auxiliary strap surrounding the second ends of said pair of poles and moved into contact with said second end strap such that said third and fourth pieces of self-locking fastening material are mated together, whereby to couple the second ends of said pair of skis and the second ends of said pair of poles together.

10. The carrier recited in claim 8, further comprising pieces of self-locking fastening material located on said first end strap, said first end strap wrapped around the first ends of said pair of skis to be transported such that said pieces of self-locking fastening material are moved into contact with and mated to one another, whereby to attach said first end strap to the first ends of said pair of skis.

11. The carrier recited in claim 8, further comprising pieces of self-locking fastening material located on said second end strap, said second end strap wrapped around the second ends of the pair of skis to be transported such that said pieces of self-locking fastening material are moved into contact with and mated to one another, whereby to attach said second end strap to the second ends of said pair of skis.

12. The carrier recited in claim 8, further comprising a piece of self-locking fastening material located on said opposite end of said cross strap and another piece of self-locking fastening material located on said shoulder strap, the opposite end of said cross strap moved into contact with said shoulder strap such that said pieces of fastening material are mated together, whereby to releasably attach said cross strap to said shoulder strap.

13. The carrier recited in claim 8, further comprising a piece of self-locking fastening material located on said shoulder strap between said first and second end straps, one of said first or second end straps being rolled along said shoulder strap in a direction towards the other end strap to shorten the length of said shoulder strap therebetween and cause one end of said piece of self-locking fastening material to be moved into contact with and mated to the opposite end of said piece of fastener material to prevent the one of said end straps from being unrolled in a direction away from said other end strap.

14. A carrier by which to enable a user to transport pairs of skis and poles, each of said skis and poles having first and second ends, and said carrier comprising:

a first end strap adapted to be attached to the first ends of said pair of skis to be transported;

a second end strap adapted to be attached to the second ends of the skis to be transported;

a shoulder strap connected between said first and second end straps and adapted to be worn over a shoulder of the user after said first and second end straps have been attached to said skis;

a cross strap to be attached to said shoulder strap to exert a pulling force thereon so as to prevent said shoulder strap from sliding off the shoulder of the user, said cross strap having a first end thereof attached to one of said first or second end straps and an opposite end releasably attached to said shoulder strap such that said cross strap extends from the one of said first or second end straps, across the back and under the shoulder of the user, to said shoulder strap to be releasably attached thereto adjacent the user's chest so that said cross strap exerts the pulling force on said shoulder strap in a direction across the chest of the wearer; and a piece of self-locking fastening material located on said shoulder strap between said first and second end straps, one of said first or second end straps being rolled along said shoulder strap in a direction towards the other end strap to shorten the length of the shoulder strap therebetween and cause one end of said piece of self-locking fastening material to be moved into contact with and mated to the opposite end of said piece of fastener material to prevent the one of said end straps from being unrolled in a direction away from said other end strap.

* * * * *